US005305508A

United States Patent [19]

Koch et al.

[11] Patent Number: 5,305,508

[45] Date of Patent: Apr. 26, 1994

[54] CABLE-BUNDLING EQUIPMENT FOR CABLE-PROCESSING MACHINES

[75] Inventors: Max Koch, Meggen; Alois Conte, Ebikon, both of Switzerland

[73] Assignee: Komax Holding AG, Meggen, Switzerland

[21] Appl. No.: 112,455

[22] Filed: Aug. 27, 1993

[30] Foreign Application Priority Data

Aug. 27, 1992 [CH] Switzerland ..... 2660/92

[51] Int. Cl.[5] ..... H01R 43/04

[52] U.S. Cl. ..... 29/33 M; 29/564.6; 29/747; 29/828

[58] Field of Search ..... 29/33 F, 33 M, 564.4, 29/564.6, 566.3, 747–749, 819, 820, 828, 868; 901/6, 8, 30

[56] References Cited

U.S. PATENT DOCUMENTS

| | | | |
|---|---|---|---|
| 3,029,494 | 4/1962 | Andren | 29/828 |
| 4,680,841 | 7/1987 | Schneider et al. | 29/749 X |
| 4,733,463 | 3/1988 | Kolanowski et al. | 29/564.6 X |
| 5,157,830 | 10/1992 | Koch | 901/6 X |

FOREIGN PATENT DOCUMENTS

| | | | |
|---|---|---|---|
| 2321882 | 2/1961 | Australia | 29/33 M |

*Primary Examiner*—Peter Dungba Vo
*Attorney, Agent, or Firm*—Sandler Greenblum & Bernstein

[57] ABSTRACT

Cable-bundling equipment for cable-processing machines, wherein, a first cable slack can be finally bundled and withdrawn already properly oriented, while the bundling operation for a second cable slack continues to proceed and is not interrupted when a faulty cable is ascertained, with this equipment including a rotatable cable receptacle unit having first and second bundle clamps, wherein the first bundle clamps are associated with the reception of fault-free cables and the second bundle clamps with the reception of faulty cables; a first gripper, pivotable into three operative settings, which, in the first operative setting takes the cable from a second gripper provided for cable transport; the cable in the second operative setting of the first gripper is transferred to a first bundle clamp, or in the third operative setting of the first gripper to a second bundle clamp; the cable end to be transferred to the respective bundle clamp being transported extending perpendicular to the direction of movement of the second gripper, while the other end, according to cable slack, is guided in a first or second channel of a cable trough extending parallel to the direction of movement of the second gripper.

10 Claims, 3 Drawing Sheets

CABLE-BUNDLING EQUIPMENT FOR CABLE-PROCESSING MACHINES

CROSS REFERENCE TO RELATED APPLICATIONS

This application claims the priority of Swiss Application No. 02 660/92-7, filed Aug. 27 1993, the disclosure of which is incorporated herein by reference in its entirety.

BACKGROUND OF THE INVENTION

1. Field of the Invention

The invention concerns cable-bundling equipment for cable-processing machines, wherein a cable trough is provided to receive a cable being treated, such that a first cable slack can be finally bundled and withdrawn already properly oriented while the bundling operation for a second cable slack continues to proceed and is not interrupted when a faulty cable is ascertained.

2. Discussion of Background and Material Information

Electrical cables of the most diverse length, for example for electrical appliances or motor vehicles, can be manufactured rationally at greater rates with cable-processing machines. The cables are usually cut off in the required lengths from material supplied in rolls and have their insulation removed at both ends, wherein the ends can, if necessary, be equipped with plugs or other connecting elements. A known machine of that kind is shown in prospectus KOMAX 40 ST, Issue 1989, of KOMAX AG, CH-6036 Dierikon-Lucerne, Switzerland. With this machine, the cables are tested for manufacturing faults or defects before being stored, and, on ascertaining a fault, cable production is interrupted until the damaged cable is removed, whereby excessive production time can be lost.

A cable-depositing device, in which a receiving trough is provided, which temporarily receives a cable which has been finally treated at one end, is disclosed in Swiss Patent Publication No. 678,420. After treatment of the second cable end, the cable is pivoted and so comes into contact with an entraining run or engagement piece of a belt drive, via which it is steered or directed towards a deposit trough extending parallel to the receiving trough. Thereafter, the pivoting device releases the cable so that it can fall into the deposit trough, wherein it is however received by a separator arranged in front of the receiving trough. After the formation of a cable slack stack of predetermined size, this stack is transferred to the deposit trough, from where is can be withdrawn and is thereafter either manually or automatically bound into a bundle for further use. Since the cables normally assume a relatively displaced position in the deposit trough after deposit therein, they must be oriented during the withdrawal for purposes of bundling thus necessitating the expenditure of additional working time.

SUMMARY OF THE INVENTION

The primary purpose or objective of this invention is cable-bundling equipment, in which the cable production is not interrupted on finding a faulty cable, the faulty cables are separated out during the bundling operation, and the cables can be withdrawn already bundled in properly oriented fashion.

This purpose of this invention is achieved via cable-bundling equipment for a cable-processing machine, including a cable trough for receiving cables being processed by the cable processing machine, the cable-bundling equipment including a cable receptacle unit rotatably secured at a mounting plate on a machine frame of the cable-processing machine; the cable receptacle unit including multiple first and second bundle clamps, wherein the multiple first bundle clamps are utilized for the reception of fault-free cables and the multiple second bundle clamps are utilized with the reception of faulty cables; a first gripper, movably secured at the mounting plate at a pivot axis is pivotable into first, second and third operative settings and includes a moveable part, the moveable part being displaceable perpendicularly relative to the pivot axis, the moveable part including two pivotable gripper jaws; a second gripper, displaceably mounted on the machine frame, is provided for the feeding of the cables; wherein the first gripper, in the first operative setting, always accepts a cable from the second gripper and, in the second operative setting transfers the cable to one of the first bundle clamps and, in the third operative setting, to a second bundle clamp, and wherein the cables are transferred, at one end of the bundle clamp, which end is retained and transported by the second gripper, perpendicularly to its direction of movement, while the other end of the cable is guided into the cable trough.

The cable-bundling equipment further includes two first bundle clamps, the two first bundle clamps being displaced by 180° relative to each other and two second bundle clamps, the two second bundle clamps being displaced by 180° relative to each other, wherein one of the first bundle clamps is utilized for the reception of a first cable slack and the other of the first bundle clamps is utilized for the reception of a second cable slack of a predetermined size.

Each of said multiple first bundle clamps includes two clamp arms, with one end of each of the clamp arms being articulately retained at a carrier of the cable receptacle unit; the other end of each of the clamp arms being provided with lips, the lips being yieldably pressed together; with the length of the lips being a multiple of the diameter of the cable; and a slide, arranged between the clamp arms, is connected with means for actuation, the slide including, at a side facing the lips, a substantially triangular cut-out and forming therewith a slack size chamber to receive a predetermined number of cables.

Preferably, the cable trough is formed of two portions, the two portions extending at right angles to each other, wherein a first portion is arranged at the machine frame so as to extend parallel to the direction of movement of the second gripper; the cable trough is also subdivided into two channels wherein a first channel is associated with the first cable slack and a second channel is associated with the second cable slack, the second cable trough portion includes a tiltable metal control plate having two settings, the tiltable control plate, depending on its setting, guiding the cable into the first or second channel; and a further slide, by means of which the first channel is closeable in the first cable trough portion after reaching a first slack side and upon the setting of the metal control plate to the second channel, is utilized for the first channel in the first cable trough.

In addition, the gripper jaws of said first gripper in the second operative setting are displaced so far during transfer of the cable to a first bundle clamp that the cable assumes a position between the lips of the clamp arms.

Thus, in summary, a rotatable cable-receiving unit or receptacle unit is provided, which includes multiple first and second bundle clamps, wherein the first bundle clamps of the receptacle are utilized for fault-free cables and the second bundle clamps of the receptacle are utilized for faulty cables. A first gripper, which is pivotable into any of three different operative settings, in its first operative setting receives the cable from a second gripper provided for the cable transport. The cable, in the second operative setting of the first gripper, is transferred to a first bundle clamp or in the third operative setting, of the first gripper, to a second bundle clamp. The one cable end to be transferred in the respective bundle clamp is transported while extending perpendicularly to the direction of movement of the second gripper, while the other cable end is guided in a cable trough arranged parallel to the direction of movement of the second gripper.

The advantages achieved by the cable-bundling equipment of this invention are particularly noteworthy in that the unproductive or down time of the cable-processing machine, during production, is reduced and that faulty cables can be rationally separated from the defect-free produced cables within a slack. These advantages are achieved via separate guidance of the cable slacks in the cable trough so that, during filling of the one bundle clamp, the full cable slack can be removed from the other bundle clamp without being obstructed by the cables of the new slack that is being produced. Thus, the feeding of cables to the new slack need not be interrupted during the withdrawal time of the existing full cable slack so that further time losses are avoided. This is achieved by the particular construction of the lips of the clamp arms so that displacement of the cables, in the slack size chamber of the bundle clamp, is avoided to a large extent during the filling operation. A yet further advantage achieved by the noted manner of feeding of the cables is that the cables can be withdrawn already properly oriented from the bundle clamps.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Prior to describing the drawings, it is to be understood that to simplify the showing thereof only enough of the structure of the cable-bundling equipment 1.1 for cable-processing machines has been illustrated therein as is needed to enable one skilled in the art to readily understand the underlying principles and concepts of the present invention.

Figure 1:
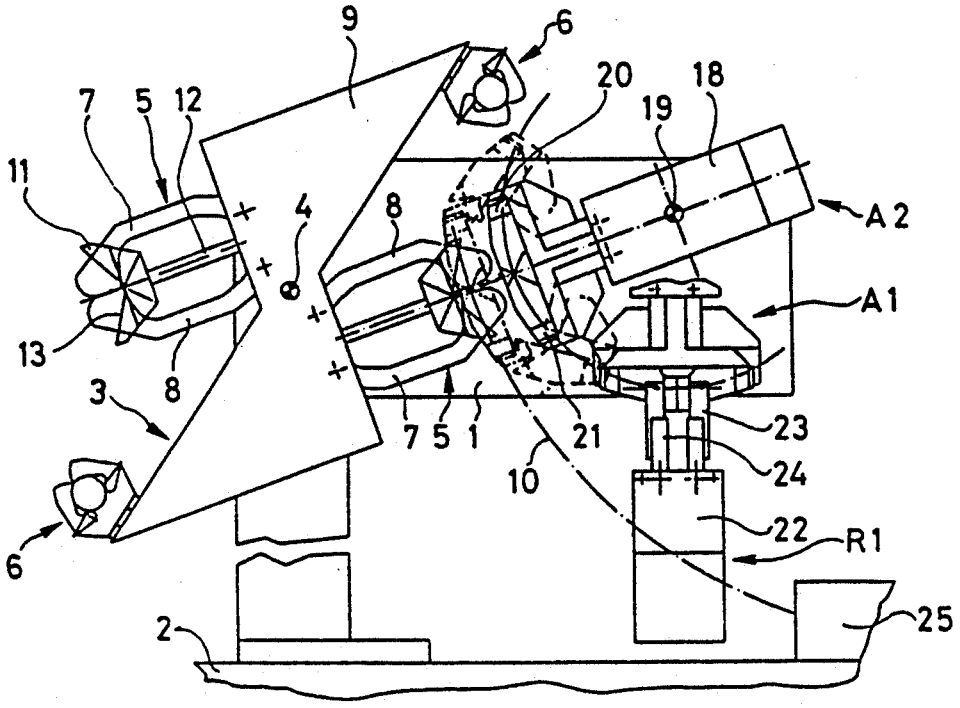
FIG. 1 is an elevational view of the cable-bundling equipment, according to the invention, during the transfer of a fault-free cable.
Figure 2:
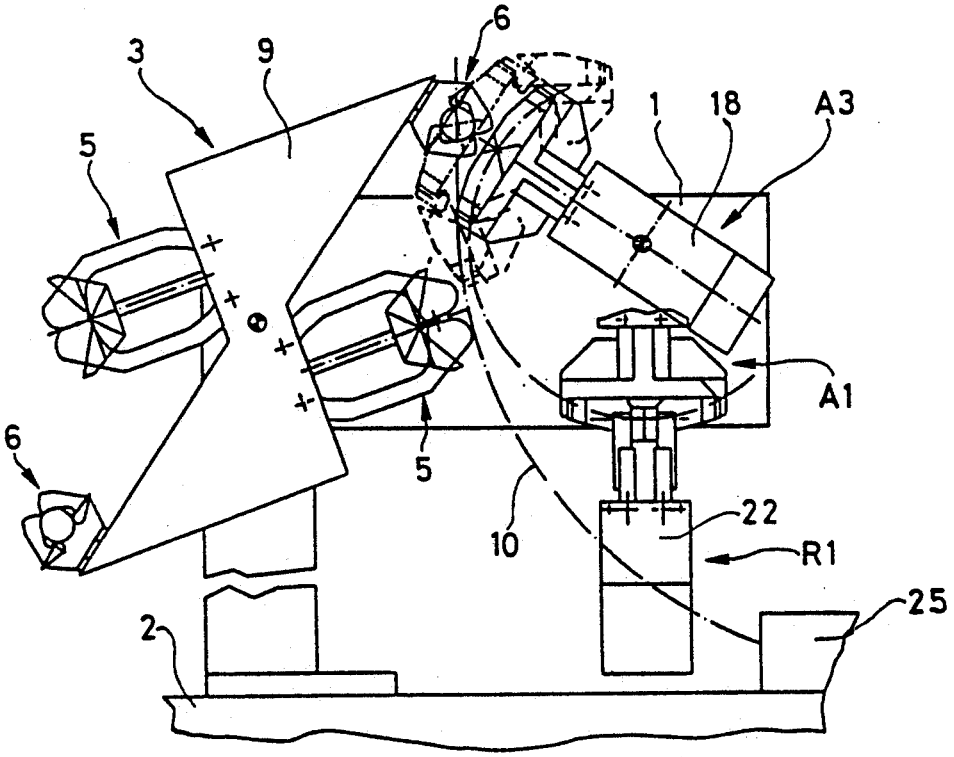
FIG. 2 is an elevational view of the cable-bundling equipment, similar to that of FIG. 1, but during the transfer of a faulty cable.
Figure 3:
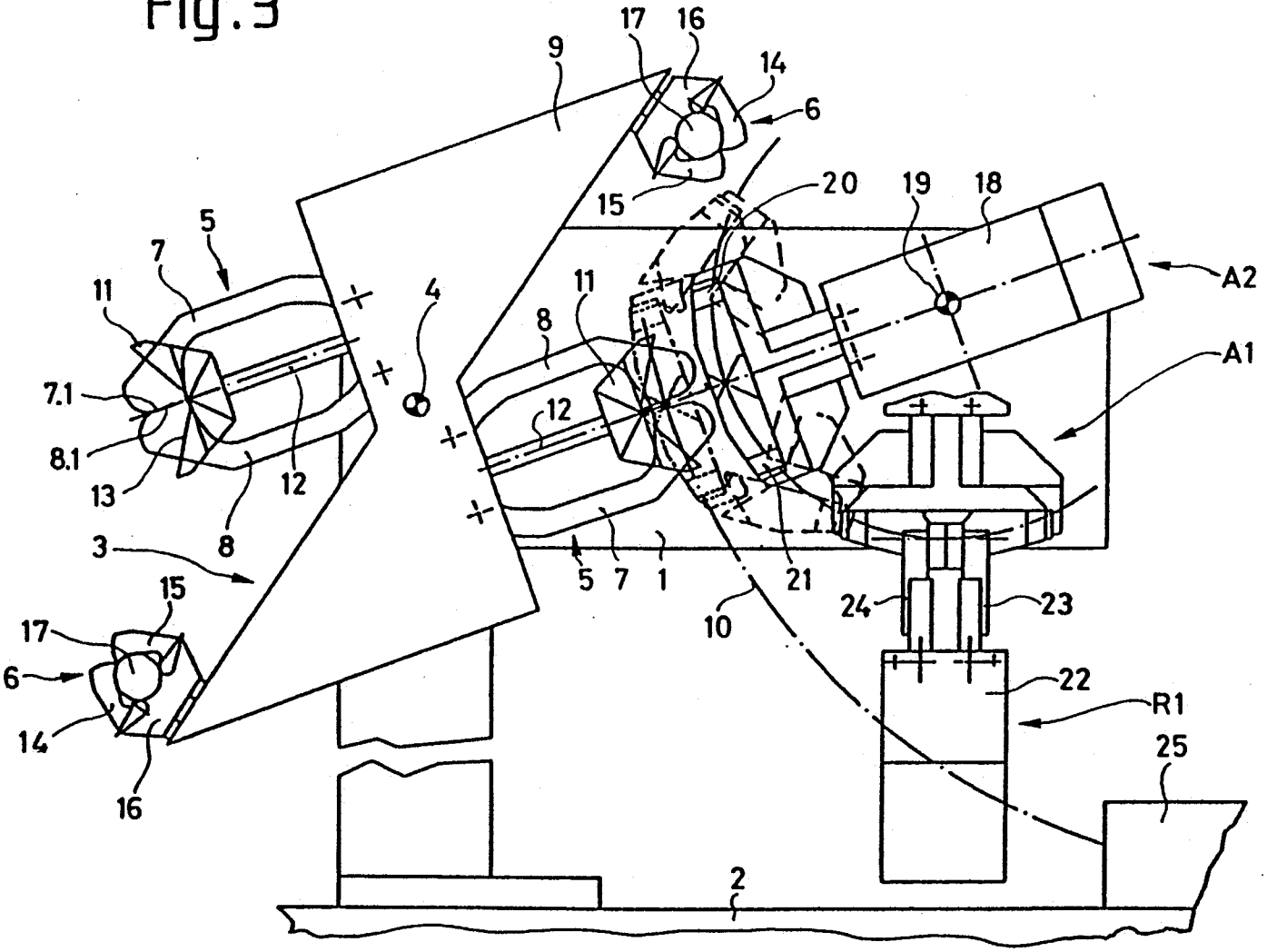
FIG. 3 is an enlarged elevational view of the cable-bundling equipment of FIG. 1, in comparison with the FIGS. 1 and 2.

Turning now specifically to the drawings, a mounting plate 1, shown in FIGS. 1–3 is connected with a machine frame 2 of a not-further-illustrated cable-processing machine. A cable receptacle unit 3 is secured at mounting plate 1 so as to be rotatable about an axis 4, wherein the rotation can be accomplished, for example, by means of a non-illustrated electrical motor or pneumatic pivoting cylinder, etc. Cable receptacle unit 3 is provided with multiple first and second bundle clamps 5 and 6,, respectively, wherein first bundle clamps 5 are utilized for the reception of fault-free cables while second bundle clamps 6 are utilized for the reception of faulty cables. In an exemplary embodiment, two first and two second bundle clamps 5 and 6 respectively, are utilized, with each of the two clamps 5 and 6 being displaced through 180° relative to each other. In this case, one first bundle clamp 5 is intended for the reception of a first cable slack and the other first bundle clamp 5 for the reception of a second cable slack, both cable slacks being of a certain size. First bundle clamps 5 consists of two opposing clamp arms 7 and 8, which at one end are carried in an articulate manner at a carrier 9 of cable receptacle unit 3. The other ends of clamp arms 7 and 8 are provided with lips 7.1 an 8.1 (FIG. 3), which are normally pressed together under the influence of a non-illustrated spring. For purposes to be described in more detail later, the length of lips 7.1 and 8.1 is a multiple of the diameter of a cable 10 adapted to be received therebetween. A slide 11, which is connected with actuating means, such as a pneumatic cylinder 12 attached at carrier 9, is arranged between the clamp arms 7 and 8. Slide 11, at its side facing the lips 7.1 and 8.1, has a substantially triangular cut-out 13, thereby forming slack size chamber 13.1 (FIG. 3) for the reception of a certain number of cables.

Second bundle clamps 6, which are smaller than first bundle clamps 5, and are provided with two clamp arms 14 and 15 (FIG. 3), are also normally pressed together via the influence of a spring (not shown). Clamp arms 14 and 15 are carried in an articulate manner at a holder 16, which in turn is fastened to carrier 9. Holder 16 is provided with semicircular cut-out 17, which serves for the reception of the faulty cables.

A first gripper 18 is pivotable into three operative settings A1, A2 and A3 and includes a moveable part 18.1. The latter, which is displaceable perpendicularly relative to a pivot axis 19 thereof, and which carries two pivotable gripper cheeks or jaws 20 and 21, is pivotally attached at the mounting plate 1. A second gripper 22, which includes two pivotable gripper cheeks or jaws 23 and 24, is arranged to be displaceable at the machine frame 2 in a manner not further illustrated. First gripper 18, second gripper 22 and cable receptacle unit 3 cooperate during the treatment of cable 10 in a manner to be described in more detail later. A cable trough 25, connected with machine frame 2, will be described more closely with reference to FIGS. 4 and 5.

Figure 4:
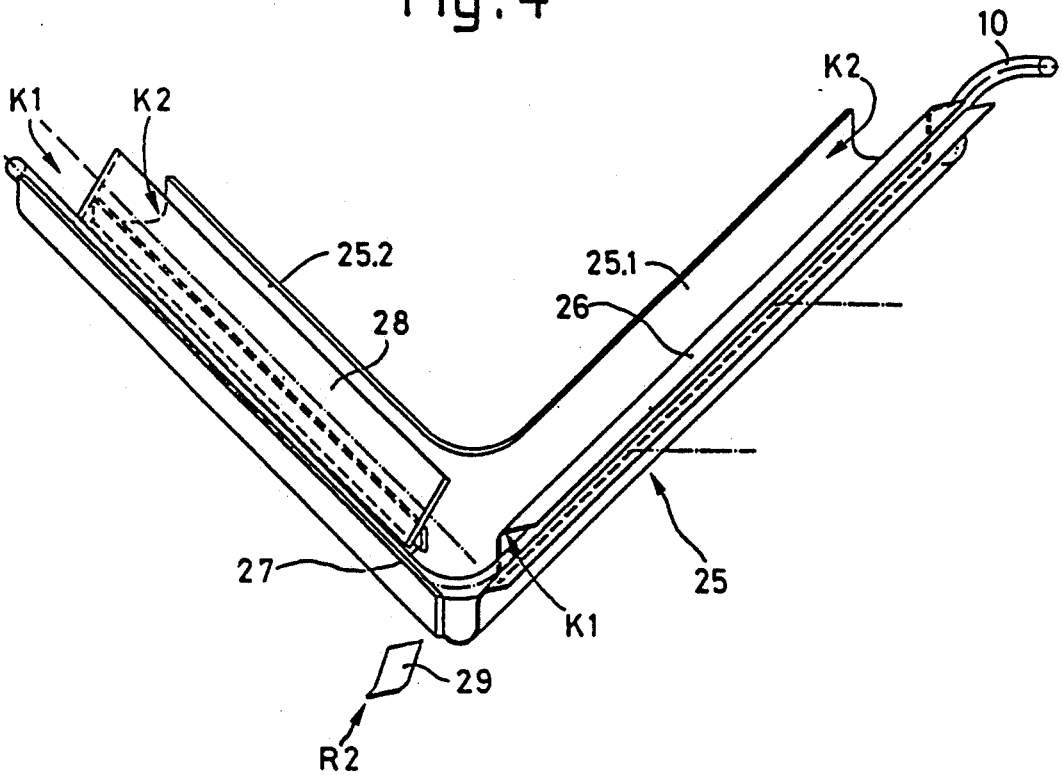
FIG. 4 is a perspective illustration of a cable trough of the cable-bundling equipment of FIG. 1 with a cable guided in a first channel.
Figure 5:
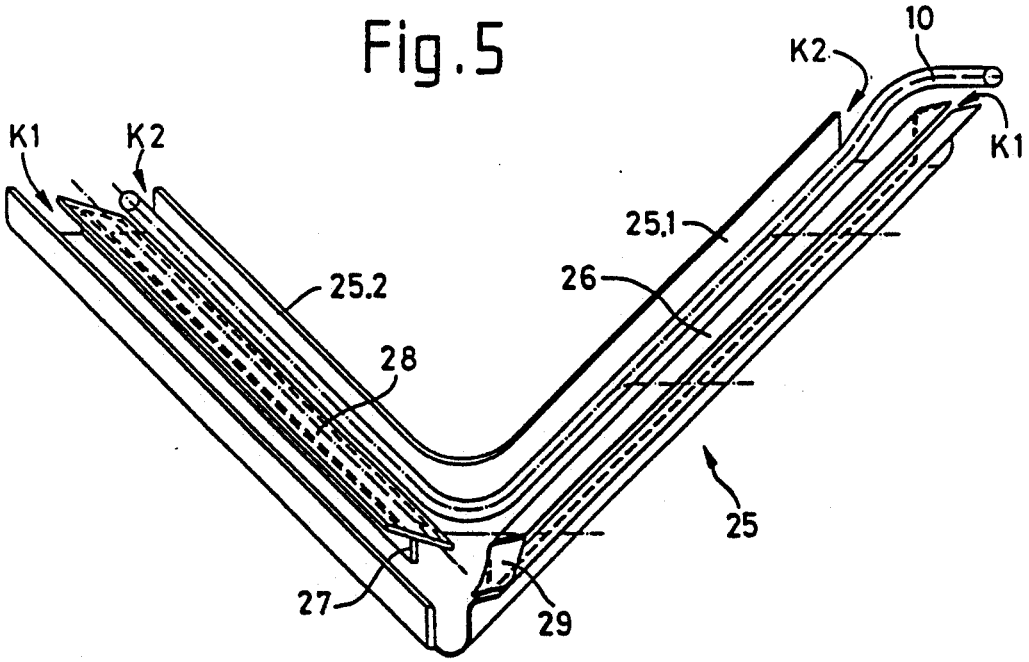
FIG. 5 is perspective illustration of the cable trough of the cable-bundling equipment of FIG. 1 with a cable guided in a second channel.

According to the FIGS. 4 and 5, cable trough 25 is formed of two portions 25.1 and 25.2, which extend at right angles to each other, wherein first portion 25.1 extends parallel to the direction of movement of second gripper 22. Each of cable trough portions 25.1 and 25.2 is subdivided by walls 26 and 27, respectively into two channels K1 and K2, wherein each first channel K1 is associated with a first cable slack and each second channel K2 with a second cable slack. Second trough portion 25.2 includes a tiltable metal control plate 28, which is attached at wall 27 and, according to this setting, guides cable 10 into first or second channel K1 or K2, respectively. A further slide 29 for first channel K1 is provided in first trough portion 25.1, by means of which first channel K1 is closable in first trough portion 25.1 after reaching the first slack size and setting tiltable metal control plate 28 to second channel K2.

Previously described cable-bundling equipment 1.1 operates as follows: For discussion purposes, let it be assumed that second gripper 22 has taken over or moved an initial cable 10 of a first slack to a non-illustrated test station for the testing of manufacturing faults and has conveyed it in the direction of arrow R1 perpendicularly below first gripper 18, with gripper 18 being disposed with opened gripper jaws 20 and 21 in first operative setting A1. During the conveying, initial cable 10 is held at one end by second gripper 22 perpendicular to its direction of movement, while the other end is guided parallel to the direction of movement in first channel K1 of cable trough 25. In operative setting A1, gripper jaws 20 and 21 of first gripper 18 open and gripper jaws 23 and 24 of second gripper 22 close, whereupon second gripper 22 returns to the test station for the purpose of taking over a further cable 10. At the same time, first gripper 18 with initial cable 10 pivots about pivot axis 19 into second operative setting A2. Let it now be further assumed that it was ascertained during testing that initial cable 10 is free from faults. In this case, cable receptacle unit 3 was turned about axle or axis 4 into a position, in which a first bundle clamp 5 stand opposite first gripper 18 (FIGS. 1 and 3). Now, gripper jaws 20 and 21 of first gripper 18 are jerkily displaced so far in the direction of first bundle clamp 5 that initial cable 10 retained by them at the end of the displacement assumes a position between lips 7.1 and 8.1 of clamp arms 7 and 8 (chain-dotted lines in FIGS. 1 and 3). Initial cable 10, is positively clamped in such a manner, that only after the arrival of additional cables, is it pressed by these additional cables into the slack size chamber, whereby a displacement of the cables in the slack size chamber is avoided to a large extent. After the transfer of initial cable 10 to first bundle clamp 5, gripper jaws 20 and 21 are opened and retracted (dashed lines in FIGS. 1 and 3). Thereafter, first gripper 18 pivots with gripper jaws 20 and 21 opened for the purpose of taking-over of a further cable 10 from second gripper 22, which has returned, in the meantime, back into first operative setting A1.

If a faulty cable is ascertained during testing, first gripper 18 is pivoted into third operative setting A3, in which setting a second bundle clamp 6 can accept the cable from first gripper 18 (FIG. 2). The transfer procedure in this case runs exactly as previously described for fault-free cables, the faulty cable however being pushed through clamp arms 14 and 15 into semicircular cut-out 17. When a first bundle clamp 5 has reached the predetermined slack size, cable receptacle unit 3 is turned through 180° so that the cable bundle can be removed via manual opening of clamp arms 7 and 8. Since the cable end transported by second gripper 22, perpendicular to its direction of movement, always displays the same length, the cables can be removed or withdrawn from bundle clamp 5 in an oriented manner so that a previous tying of the bundle is feasible. During the withdrawal, the other first bundle clamp 5 can already be filled with cables of the second slack so that no time is wasted. In this case, the cables are fed through second channel K2 of the cable trough 25, for which purpose metal control plate 28 is tilted into another setting and first channel K1, in first trough portion 25.1, is closed by means of the, for example pneumatically actuatable, further slide 29 (in the direction of arrow R2, FIG. 4).

While there are shown and described present preferred embodiments of the invention, it is to be distinctly understood that the invention is not limited thereto, but may be otherwise variously embodied and practiced within the scope of the following claims.

What is claimed is:

1. Cable-bundling equipment for a cable-processing machine, including a cable trough for receiving cables being processed by said cable processing machine, said cable-bundling equipment comprising:

a cable receptacle unit rotatably secured at a mounting plate on a machine frame of said cable-processing machine;

said cable receptacle unit including multiple first and second bundle clamps, wherein said multiple first bundle clamps are utilized for receptively clamping fault-free cables and said multiple second bundle clamps are utilized with receptively clamping faulty cables;

a first gripper, movably secured at a pivot axis on said mounting plate, said first gripper is pivotable about said pivot axis and extending into first, second and third operative setting positions, said first gripper including a moveable part, said moveable part being displaceable perpendicularly relative to said pivotal axis, said moveable part including two pivotable gripper jaws;

a second gripper, displaceably mounted on said machine frame, is provided for feeding said cables;

wherein said first gripper, in said first operative setting, always accepts a cable from said second gripper and, in said second operative setting transfers said cable to one of a first bundle clamp and, in said third operative setting, to a second bundle clamp; and wherein said cables are transferred, at one end of the bundle clamp, which end is retained and transported by said second gripper, perpendicularly to a direction of movement of said second gripper, while the other end of said cable is guided in said cable trough.

2. The cable-bundling equipment of claim 1, wherein said cable trough is formed of two portions, said two portions extending at right angles to each other, wherein a first portion is arranged at said machine frame so as to extend parallel to the direction of movement of said second gripper;

said cable trough is also subdivided into two channels wherein a first channel is associated with a first cable slack and a second channel is associated with a second cable slack, said second cable trough portion includes a tiltable control plate having two settings, said tiltable control plate, depending on its setting, guiding said cable into one of said first and second channels; and a further slide, by means of which said first channel is closeable in said first cable trough portion after reaching a first slack size and upon the setting of said control plate to said second channel, is utilized for said first channel in said first cable trough.

3. A cable-bundling equipment of claim 1, wherein each of said multiple first bundle clamps includes:

two clamp arms, with one end of each of said clamp arms being retained in an articulated manner at a carrier of said cable receptacle unit;

the other end of each of said clamp arms being provided with lips, said lips being yieldably pressed together;

with the length of said lips being a multiple of the diameter of said cable; and a slide, arranged between said clamp arms, is connected with means for actuation, said slide including, at a side facing said lips, a substantially triangular cut-out and forming therewith a slack size chamber to receive a predetermined number of cables.

4. A cable-bundling equipment of claim 3, wherein the gripper jaws of said first griper in said second operative setting are displaced so far during transfer of said cable to a first bundle clamp that said cable assumes a position between the lips of said clamp arms.

5. The cable-bundling equipment of claim 1, including two first bundle clamps, said two first bundle clamps being displaced by 180° relative to each other and two second bundle clamps, said two second bundle clamps being displaced by 180° relative to each other, wherein one of said first bundle clamps is utilized for receptively clamping a first cable slack and the other of said first bundle clamps is utilized for receptively clamping a second cable slack of a predetermined size.

6. The cable-bundling equipment of claim 5, wherein said cable trough is formed of two portions, said two portions extending at right angles to each other, wherein a first portion is arranged at said machine frame so as to extend parallel to the direction of movement of said second gripper;

said cable trough is also subdivided into two channels wherein a first channel is associated with the first cable slack and a second channel is associated with the second cable slack, said second cable trough portion includes a tiltable control plate having two settings, said tiltable control plate, depending on its setting, guiding said cable into one of said first and second channels; and a further slide, by means of which said first channel is closeable in said first cable trough portion after reaching a first slack size and upon the setting of said control plate to said second channel, is utilized for said first channel in said first cable trough.

7. Cable-bundling equipment for a cable-processing machine, said cable-bundling equipment comprising:

a cable receptacle unit rotatably secured at a mounting plate on a machine frame of said cable-processing machine;

said cable receptacle unit including multiple first and second bundle clamps, wherein said multiple first bundle clamps are utilized for receptively clamping fault-free cables and said multiple second bundle clamps are utilized with receptively clamping faulty cables;

a first gripper, movably secured at a pivot axis on said mounting plate, said first gripper is pivotable about said pivot axis and extending into first, second and third operative setting positions, said first gripper including a moveable part, said moveable part being displaceable perpendicularly relative to said pivot axis, said moveable part including two pivotable gripper jaws;

a second gripper, displaceably mounted on said machine frame, is provided for feeding said cables;

wherein said first gripper, in said first operative setting, always accepts a cable from said second gripper and, in said second operative setting transfers said cable to one of a first bundle clamp and, in said third operative setting, to a second bundle clamp; and wherein said cables are transferred, at one end of the bundle clamp, which end is retained and transported by said second gripper, perpendicularly to a direction of movement of said second griper.

8. The cable-bundling equipment of claim 7, including means for receiving cables being processed by said cable processing machine, with the other end of said cable being guided in said means for receiving cables.

9. The cable-bundling equipment of claim 8, wherein said means for receiving cables takes the form of a cable trough.

10. The cable-bundling equipment of claim 9, wherein said cable trough is formed of two portions, said two portions extending at right angles to each other, wherein a first portion is arranged at said machine frame so as to extend parallel to the direction of movement of said second gripper;

said cable trough is also subdivided into two channels wherein a first channel is associated with a first cable slack and a second channel is associated with a second cable slack, said second cable trough portion includes a tiltable control plate having two settings, said tiltable control plate, depending on its setting, guiding said cable into one of said first and second channels; and a further slide, by means of which said first channel is closeable in said first cable trough portion after reaching a first slack size and upon the setting of said control plate to said second channel, is utilized for said first channel in said first cable trough.

* * * * *